United States Patent [19]

Stepe

[11] 4,047,312

[45] Sept. 13, 1977

[54] CORNER TOOTH ASSEMBLY

[75] Inventor: Visvaldis A. Stepe, Willow Springs, Ill.

[73] Assignee: Caterpillar Tractor Co., Peoria, Ill.

[21] Appl. No.: 721,654

[22] Filed: Sept. 8, 1976

[51] Int. Cl.[2] ..... E02F 9/28

[52] U.S. Cl. ..... 37/141 R; 172/719; 172/777

[58] Field of Search ..... 37/141 R, 141 T, 142 R, 37/142 A, 118 R, 118 A, DIG. 12; 172/777, 719, 713; 214/145 R, 145 A

[56] References Cited

U.S. PATENT DOCUMENTS

| | | | |
|---|---|---|---|
| 981,666 | 1/1911 | Mason, Jr. | 37/142 R |
| 1,208,054 | 12/1916 | Vanderhoef | 37/141 T |
| 2,164,988 | 7/1939 | De Biasi | 37/141 T |
| 2,716,824 | 9/1955 | Francis | 37/141 R X |
| 2,914,868 | 12/1959 | Launder | 172/777 |
| 2,965,989 | 12/1960 | Hibbard | 37/141 T UX |
| 3,029,534 | 4/1962 | Rakisits | 37/141 T |
| 3,281,972 | 11/1966 | Kerestes | 37/141 R |
| 3,289,331 | 12/1966 | Freeman | 172/777 |
| 3,520,076 | 7/1970 | Nichols | 37/141 R |
| 3,621,594 | 11/1971 | Hahn et al. | 37/141 R |
| 3,748,762 | 7/1973 | Tarrant | 37/141 T |
| 3,812,608 | 5/1974 | Ratkowski | 37/141 T |
| 3,961,788 | 6/1976 | Helton et al. | 37/141 R X |

*Primary Examiner*—Clifford D. Crowder
*Attorney, Agent, or Firm*—Charles E. Lanchantin, Jr.

[57] ABSTRACT

A corner tooth assembly which is removably secured to the corner of an implement for engaging the earth in a longitudinally oriented forward direction, and which includes a laterally extending bottom plate, a side plate integrally secured to the bottom plate, and an elongated forwardly extending earth penetrating structure integrally secured to the bottom and side plates for overlappingly engaging the implement protectingly exteriorly of the corner thereof.

7 Claims, 2 Drawing Figures

CORNER TOOTH ASSEMBLY

BACKGROUND OF THE INVENTION

The present invention is related to an earthmoving implement, and more particularly to a replaceable corner tooth assembly therefor.

Sectionalized cutting edges and replaceable adapters and wear tips have been widely adopted for use on various earthmoving implements, such as loader buckets, scraper bowls, bulldozer blades and the like. This permits the individual members thereof to be replaced or serviced without the expense of replacing the entire cutting edge. It is well recognized that the outside leading corners of these implements are particularly prone to damage and accelerated rates of wear as a result of frequent engagement with rocks, for example. Consequently, it is mandatory in many cases that certain members be conveniently replaceable, as by securing them on to the integrally welded body of the implement by a plurality of retaining bolts.

Exemplifying the prior art in this area are the following U.S. Pat. Nos.:

- U.S. Pat. No. 2,164,988 issued July 4, 1939 to C. P. DeBiasi
- U.S. Pat. No. 2,914,868 issued Dec. 1, 1959 to E. L. Launder
- U.S. Pat. No. 3,029,534 issued Apr. 17, 1962 M. Rakisits
- U.S. Pat. No. 3,281,972 issued Nov. 1, 1966 S. R. Kerestes
- U.S. Pat. No. 3,621,594 issued Nov. 23, 1971 to F. C. Hahn, et al.
- U.S. Pat. No. 3,748,762 issued July 31, 1973 to J. Tarrant Unfortunately, when many of these prior art end bits have been removed for servicing, additional costly down time has been involved in the servicing of the corners of the implements. For example, a cutting torch is often used to cut out the worn semi-permanent side pieces and bottom plates at the front corners of the implement, and welding equipment is used to install new parts in their places before the end bits are reinstalled.

Another problem with these earlier arrangements is that they have had continual difficulty with providing an agressive penetrating corner tip therewith that can effectively transfer high forces into the implement. Some, for example, only transmit working forces from the tip rearwardly into the horizontal floor member of the implememt, while others transmit these forces only into the vertical side wall member thereof. The result of either case is a construction that is weak in resisting forces normal thereto.

SUMMARY AND OBJECTS OF THE INVENTION

Accordingly, the principle object of this invention is to provide an effective corner tooth assembly which may be economically replaceably secured to the corner of an earthmoving implement in order to protect the exterior wear surfaces thereof.

Another object of the present invention is to provide such a corner tooth assembly which may be easily handled during installation or removal thereof.

Another object is to provide a rugged corner tooth assembly of the character described which can be structurally securely anchored both vertically and horizontally to the body of the implement for additional strength.

Another object is to provide a corner tooth assembly of the aforementioned type which can agressively penetrate the earth or can be used for prying by including a forwardly extending penetrating nose portion therewith.

Other objects and advantages of the present invention will become more readily apparent upon reference to the accompanying drawings and the following description.

DESCRIPTION OF THE PREFERRED EMBODIMENT

Figure 1:
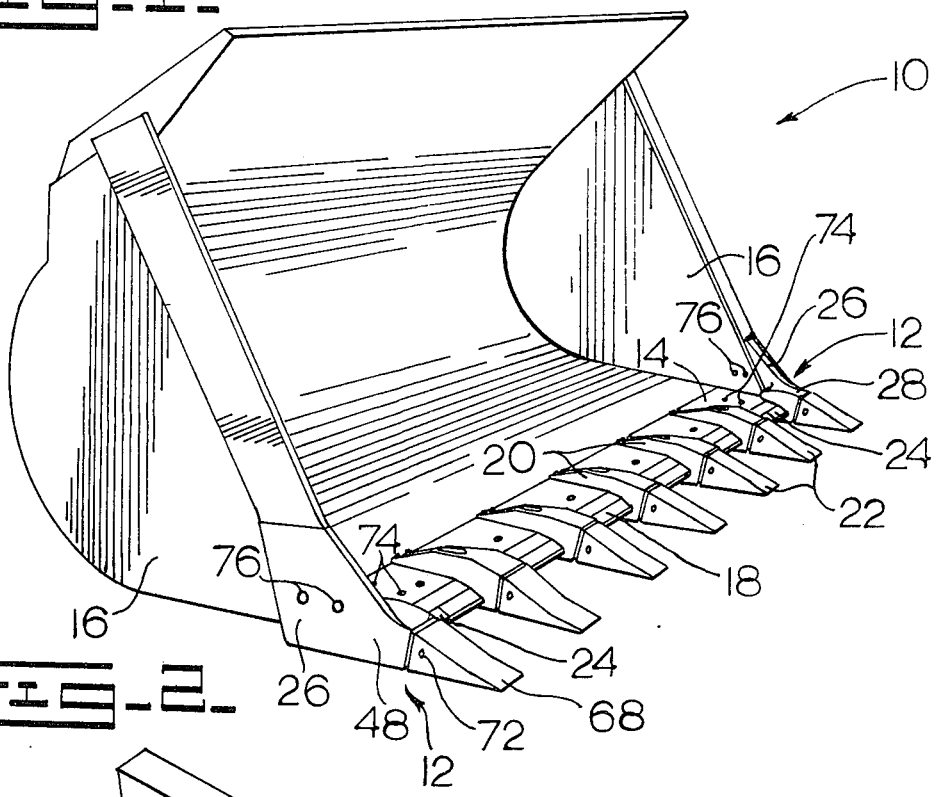
FIG. 1 is a perspective view of an earthmoving implement including a pair of corner tooth assemblies constructed in accordance with the present invention installed thereon.

With reference to the drawings, an earthmoving implement 10 such as the loader bucket illustrated includes a pair of corner tooth assemblies 12 constructed in accordance with the present invention at the opposite sides thereof. Each of these corner tooth assemblies protects the front corners of the bucket by exteriorly overlapping and extending forwardly of a transversely and horizontally disposed floor member 14 and a vertically oriented side wall member 16 which are integrally secured to the bucket as by welding or the like. The bucket also includes a removable cutting edge member 18 which is secured to the lower face of the floor member laterally across the front portion thereof and a plurality of bolted-on adapters 20 and replaceable wear tips 22 of conventional construction thereon.

Figure 2:
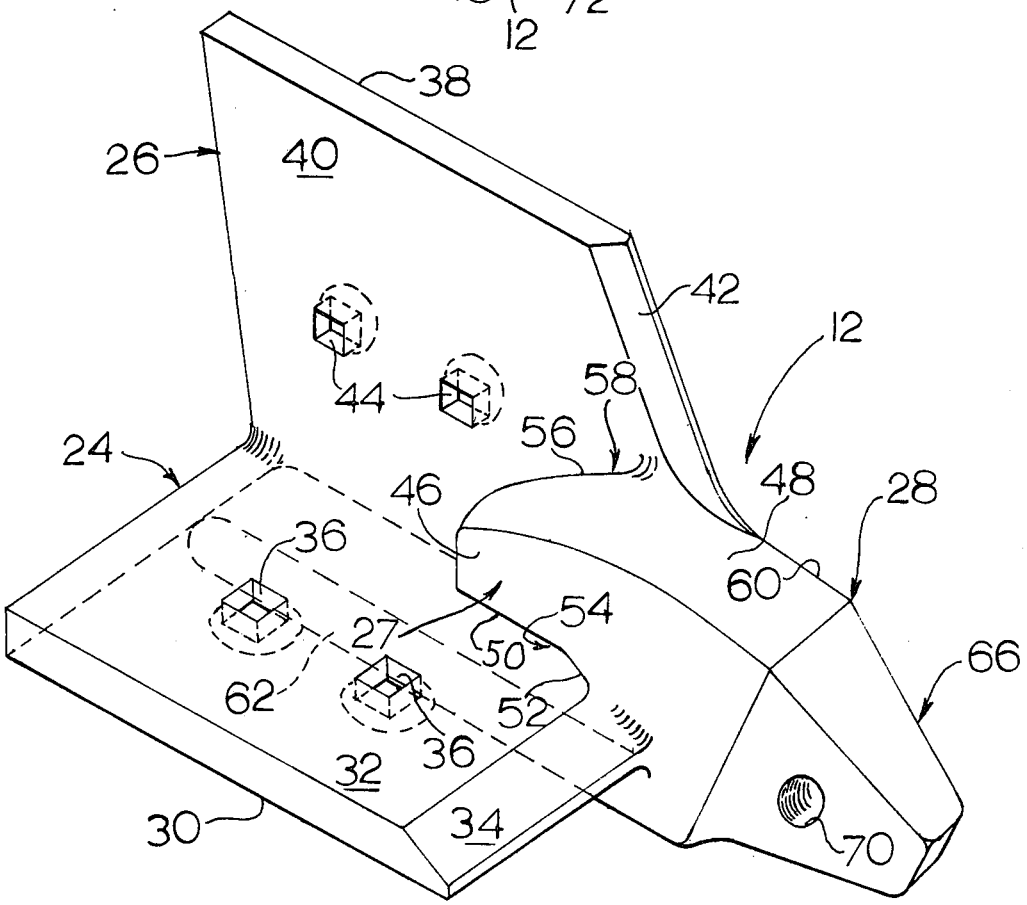
FIG. 2 is an enlarged perspective view of the left hand corner tooth assembly of FIG. 1 to show details of construction thereof.

Each of the corner tooth assemblies 12 consists of four basic portions, namely a horizontal and transversely extending bottom plate or cutting edge 24, a vertically extending side protection plate 26, a rearwardly extending inside hook member 27, and a forwardly extending earth penetrating member 28 as is representatively shown by the left hand corner tooth assembly illustrated in FIG. 2. It is to be appreciated that the right hand corner tooth assembly is a mirror image thereof.

More particularly, the corner tooth bottom plate or cutting edge 24 is generally rectangular and includes a bottom surface 30, a top surface 32, and a forwardly disposed and upwardly facing inclined cutting surface 34. Moreover, a pair of suitably profiled plow bolt openings 36 are vertically defined through the cutting edge in a longitudinally aligned manner.

Likewise, the side protection plate 26 includes an outer surface 38, an inner surface 40, and a forwardly disposed and laterally inwardly facing inclined side cutting surface 42. Furthermore, a pair of profiled plow bolt openings 44 are defined laterally through the side wall in a longitudinally aligned manner.

Referring now to the corner tooth hook member 27, it may be seen to include a longitudinally oriented and horizontally disposed leg 46 which extends rearwardly from a body portion 48. This body portion is integrally blendably associated with the inside front corner surfaces of both the cutting bottom plate 24 and the side plate 26, and permits the leg to extend rearwardly in substantially parallel and spaced apart relation respectively from the top surface 32 and the inner surface 40 thereof. More specifically, the leg has a bottom surface 50 and an inclined lower surface 52 which defines with the top surface 32, a slot 54, and also has a side wall surface 56 which defines with the inner surface 40 a recess 58. Upon inspecting FIG. 2, it will be noted that the side cutting surface 42 blends downwardly and forwardly in a converging and vanishing manner into the body portion 48, and with the outer side surface 38 being coplanar with an exterior side surface 60 of the body portion.

The fourth portion of the corner tooth assembly 12, namely the earth penetrating member 28, extends forwardly from the body portion 48 and is of relatively substantial cross section. Such thick or rugged construction permits the penetrating member to better resist and transmit significantly large corner forces into the bottom plate 24, the side plate 26, and the hook member 27. In order to improve the force transmitting capability of the corner tooth assembly 12 and to improve the wear life thereof, a lower leg 62 extends longitudinally below the length of the bottom plate 24 as shown in broken lines. Thus, it is evident that relatively large loads can be transferred rearwardly into the bottom body portion and the strong bifurcated construction including the upper foreshortened leg 46 and the lower elongated legs 62, as well as into the bottom plate and the side plate thereof.

In an advantageous manner the earth penetrating member 28 is provided with a forwardly converging tapered nose portion 66 thereon in order to receive a correspondingly socketed and replaceable wear tip 68 thereon as shown in FIG. 1. A cylindrical passage 70 is defined laterally through the nose portion and a quick-release retaining pin arrangement 72 of conventional construction is insertable therethrough and through the wear tip to removably secure it to the body.

As shown in FIG. 1, the bottom plate 24 of each of the corner tooth assemblies 12 is secured exteriorly against the floor member 14 of the bucket 10 by a pair of countersunk plow bolts and associated nuts 74 which extend upwardly through the openings 36 in the bottom plate and through the floor member. Likewise, the side protection plate 26 is secured exteriorly against the side wall member 16 by a pair of countersunk plow bolts and associated nuts 76.

OPERATION

While the operation of the present invention is believed clearly apparent from the foregoing description, further amplification will subsequently be made in the following brief summary of such operation. One of the corner tooth assemblies 12 may be conveniently lifted by a serviceman and placed on the corner of the bucket 10 by moving it rearwardly so that the slot 54 fully receives the floor member 14 until it abuts the inclined surface 52. This permits the bottom surface 50 of the upper leg 46 and the top surface 32 of the bottom plate 24 to interlockingly entrap the floor member and to allow vertical working forces on the nose portion 66 to be transmitted thereby. Rearwardly directed forces caused by the normal forward movement of the bucket through the earth are primarily directed through the inclined surface 52 and to the plow bolts 74.

On the other hand, twisting forces caused by bucket pry-out action in utilizing the penetrating member 28 results in a resisting reaction from both the bottom plate 24 and the side protection plate 26 into the floor member 14 and the side wall member 16 of the bucket 10. This is an extremely rugged and stable reaction because of the normal or right angle relationship between the associated members. In addition, the inner hook member 27 aids substantially in resisting these loads. Moreover, because of the aforementioned relationships, the conveniently installable bolts and nuts 74 and 76 are relieved from accepting and transmitting the full force of these high loads, so that only a pair of each are required in each plane for positively securing one of the corner tooth assemblies to the bucket.

In view of the foregoing, it is readily apparent that the corner tooth assembly 12 of the present invention is simple and economical in its construction, and yet is rugged enough to transmit high working forces rearwardly into the implement while at the same time exteriorly protecting the integral corner portion thereof. It may be easily handled and serviced by utilizing only two pairs of plow bolts and nuts 74 and 76 which are individually aligned in a normal direction of working movement. While the exterior head portions thereof are recessed in order to minimize external wear, the nut portion thereof is individual aligned in the normal direction of working movement so that they tend to protect each other from excessive wear. Furthermore, each corner tooth assembly is securely anchored to the implement in both the vertical and horizontal directions for additional strength, and with the heavier earth penetrating member 28 being disposed fully outwardly to a maximum degree to better transmit working forces move directly into the bottom plate 24, the side plate 26, and to the floor member and side wall members of the implement. Advantageously, while the rugged block-like body portion 48 is integrally cast smoothly into the flat bottom and side plates and fully coextensive exteriorly therewith, such construction does not interfere with the earth penetrating action of the inclined cutting surfaces 34 and 42 which blendably extend therefrom for a distance approximately equal to, or slightly greater than, the width and height of the body portion respectively.

While the invention has been described and shown with particular reference to a preferred embodiment, it will be apparent that other variations might be possible such as by fabricatingly securing individual members thereof together rather than integrally casting the corner tooth assembly as shown that would fall within the scope of the present invention, which is not intended to be limited except as defined in the following claims.

What is claimed is:

1. A corner tooth assembly, adapted to be removably secured to the corner of an implement having a floor member and side wall member substantially normal thereto, comprising:

a bottom wear plate disposable exteriorly of said floor member and having a forwardly extending cutting edge thereon;

a side wear plate disposable exteriorly of said side wall member and having a forwardly extending cutting edge thereon;

a body portion of substantial cross section integrally associated with a front portion of said bottom plate and said side plate;

an earth penetrating member which extends forwardly from said body portion; and a hook member extending rearwardly from said body portion and being of a construction sufficient for interlocking said floor member and said side wall member immediately inwardly the intersection thereof.

2. The corner tooth assembly of claim 1 wherein said penetrating member has a nose portion thereon, and said corner tooth assembly includes a replaceable wear tip for mounting on said nose portion.

3. The corner tooth assembly of claim 1 including first retaining means for securing said bottom wear plate upwardly and protectingly against said floor member and second retaining means for securing said side plate inwardly and protectingly against said side wall member, said first and second retaining means being disposed at substantially right angles to one another.

4. The corner tooth assembly of claim 3 wherein said first retaining means includes a pair of longitudinally aligned fastening devices extending through said bottom plate and said floor member, and said second retaining means includes a pair of longitudinally aligned fastening devices extending through said side plate and said side wall member.

5. The corner tooth assembly of claim 3 wherein said first and second retaining means include a plurality of cooperating bolts and nuts.

6. The corner tooth assembly of claim 1 including a lower leg integrally associated with and positioned below said bottom plate, said lower leg extending rearwardly from said body portion.

7. The corner tooth assembly of claim 1 wherein said bottom wear plate and said side wear plate extend rearwardly and define a common, aligned rear edge.

* * * * *